US005803141A

United States Patent [19]

Patterson

[11] Patent Number: 5,803,141

[45] Date of Patent: Sep. 8, 1998

[54] COMBINATION WOOD SPLITTER AND LOADER

[76] Inventor: Toy R. Patterson, 270 Woods Rd., Oliver Springs, Tenn. 37840

[21] Appl. No.: 910,950

[22] Filed: Aug. 8, 1997

[51] Int. Cl.[6] ..... B27L 7/00

[52] U.S. Cl. ..... 144/195.1; 144/193.1; 144/195.8; 144/366

[58] Field of Search ..... 144/193.1, 195.1, 144/195.8, 366, 4.1, 24.13

[56] References Cited

U.S. PATENT DOCUMENTS

| | | | |
|---|---|---|---|
| 4,437,502 | 3/1984 | Staver | 144/195.1 |
| 4,446,898 | 5/1984 | Manteufel | 144/195.1 |
| 4,453,580 | 6/1984 | Patten | 144/195.1 |
| 4,501,309 | 2/1985 | Sinden | 144/195.1 |
| 4,559,985 | 12/1985 | May | 144/195.1 |
| 4,782,868 | 11/1988 | Collier et al. | 144/195.1 |
| 5,320,149 | 6/1994 | Peterson et al. | 144/195.1 |
| 5,441,090 | 8/1995 | Hill et al. | 144/4.1 |

*Primary Examiner*—W. Donald Bray
*Attorney, Agent, or Firm*—Joseph A. Marasco

[57] ABSTRACT

Apparatus mountable to a support vehicle for splitting and loading firewood the apparatus which includes:

a. a rigid connecting member, the connecting member having a proximal component and a distal component, the proximal component mountable to the support vehicle, the distal component traversably mounted to the proximal component, the distal component including traversing means for traversing the distal component relative to the proximal component; and b. a wood splitter supported in a downward orientation by the connecting member and rigidly mounted to the distal component, the wood splitter traversable via the traversing means into a selectable position which is in alignment with the ends of a wood piece.

19 Claims, 5 Drawing Sheets

COMBINATION WOOD SPLITTER AND LOADER

FIELD OF THE INVENTION

The present invention relates to wood splitters, and more particularly to wood splitters which, under the control of a single operator, position the splitter above and in alignment with the ends of a wood piece, grasp and pick up the wood piece by the cut ends, transfer the wood piece to a position over a receptacle, split the wood piece into at least two split wood pieces, allowing the split wood pieces to fall into the receptacle.

BACKGROUND OF THE INVENTION

Many mechanisms have been devised for various stages in the preparation of firewood. One of the most labor-intensive stages is the splitting of wood pieces which usually are logs that have been cross-cut to an appropriate length, and need to be reduced in size along the wood grain. Powered mechanical log splitters have reduced the labor and are used widely.

In efforts to further reduce labor or to provide convenience, wood splitters have been mounted in combination with other mechanisms. Some notable examples follow:

- U.S. Pat. No. 4,437,502 issued on Mar. 20, 1984 describes a trailer mounted log splitter. U.S. Pat. No. 4,446,898 issued on May 8, 1984 describes a self-elevating wood splitter and mounting arrangement. U.S. Pat. No. 4,453,580 issued on Jun. 12, 1984 describes a wood splitting device utilizing a platform for supporting the wood.
- U.S. Pat. No. 4,501,309 issued on Feb. 26, 1985 describes a portable wood splitter which uses a pair of upstanding vertically elongated components pivotally connected at the upper ends for swinging movement of the lower ends to split wood. The device can be transported like a hand truck. Wood pieces must be manually placed on the device and loaded into a receptacle after splitting.
- U.S. Pat. No. 4,459,985 issued on Dec. 24, 1985 describes a boom suspended wood splitter wherein the wood splitter is suspended by means of a flexible line. The device described therein can grasp, pickup, split, and load split wood into a receptacle, but lacks means for traversing the splitter into alignment with the ends of a piece of wood. That function must therefore be carried out by manually manipulating the splitter.
- U.S. Pat. No. 4,782,868 issued on Nov. 2, 1987 describes a wood splitter backhoe attachment which includes a base member with a platform to support the wood thereupon attached to the dipperstick of the backhoe and a wedge member attached to the hydraulic curl cylinder of the backhoe to split the wood. The wood splitter is located along the top of the dipperstick, and therefore cannot grasp and pick up a wood piece from the ground.

In spite of the many improvements that are manifest in wood splitting technology, there is a need for a machine, which, under the control of a single operator, is mechanically capable of positioning the splitter above and in alignment with the ends of a wood piece, grasping and picking up the wood piece by the ends, transferring the wood piece to a position above a receptacle, splitting the wood piece into at least two split wood pieces, and allowing the split wood pieces to fall into the receptacle.

OBJECTS OF THE INVENTION

Accordingly, it is an object of the present invention to provide a combination boom/wood splitter which mechanically positions the splitter above and in alignment with the ends of a wood piece.

It is another object of the present invention to provide a combination boom/wood splitter which positions the splitter above and in alignment with the ends of a wood piece, grasps and pick up the wood piece by the ends thereof, transfers the wood piece to a receptacle, splits the wood piece into at least two pieces, and deposits the split wood pieces into the receptacle.

Further and other objects of the present invention will become apparent from the description contained herein.

SUMMARY OF THE INVENTION

In accordance with one aspect of the present invention, the foregoing and other objects are achieved by apparatus mountable to a support vehicle for splitting and loading firewood the apparatus which includes:

a. a rigid connecting member, the connecting member having a proximal component and a distal component, the proximal component mountable to the support vehicle, the distal component traversably mounted to the proximal component, the distal component including traversing means for traversing the distal component relative to the proximal component; and b. a wood splitter supported in a downward orientation by the connecting member and rigidly mounted to the distal component, the wood splitter traversable via the traversing means into a selectable position which is in alignment with the ends of a wood piece.

In accordance with another aspect of the present invention, apparatus for splitting and loading firewood includes:

a. a boom having a distal end which is vertically and horizontally positionable;

b. a positioning means for vertically and horizontally positioning the distal end of the boom;

c. a rigid connecting member supported by the boom, the connecting member having a proximal component and a distal component, the proximal component operably connected in hanging fashion to the distal end of the boom, the distal component traversably mounted to the proximal component, the distal component including traversing means for traversing the distal component relative to the proximal component; and d. a wood splitter supported in a downward orientation by the connecting member and rigidly mounted to the distal component, the wood splitter traversable via the traversing means into a selectable position which is in alignment with the ends of a wood piece.

In accordance with a further aspect of the present invention, a wood splitter adapted for operating from a hanging position includes:

a. a first elongated member having an upper end and a lower end;

b. a second elongated member having an upper end and a lower end;

c. a connecting member having a fork; and d. a wood splitter wedge operably attached to at least one of the lower ends, the first elongated member and the second elongated member pivotally disposed in the fork for the relative swinging of the lower ends toward and away from each other.

For a better understanding of the present invention, together with other and further objects, advantages and capabilities thereof, reference is made to the following disclosure and appended claims in connection with the above-described drawings.

DETAILED DESCRIPTION OF THE INVENTION

A wood splitter in accordance with the present invention can be mounted and supported by any suitable support vehicle which has the functions of mobilizing the wood splitter and supplying appropriate power thereto for powering—supplying power for the operation of the various elements of the present invention. Suitable support vehicles include, but are not limited to tractors, trucks, backhoes, forklifts, cranes, loaders, draglines, recreational vehicles, earth-moving vehicles, and the like. It is particularly desirable for a support vehicle to have a boom for carrying out the aforementioned functions.

Figure 1:
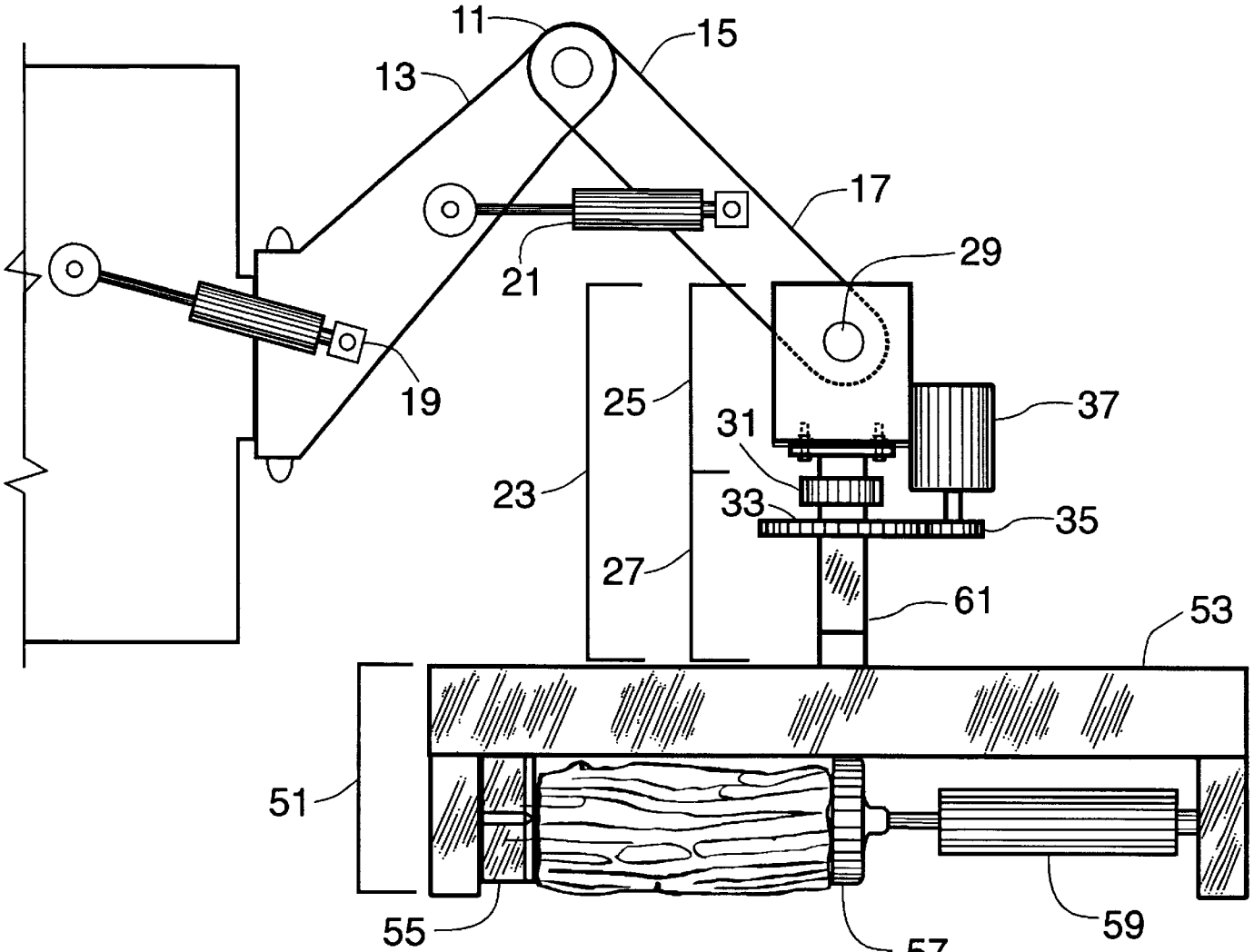
FIG. 1 is a schematic side view, not to scale, of a combination wood splitter and loader in accordance with an embodiment of the present invention.

A boom upon which a splitter is mounted in accordance with the present invention can be of any construction wherein the distal end of the boom is both vertically and horizontally positionable. For horizontal positioning,the boom can swing around a pivot point, such as in the case of a backhoe boom, which can swing in an arc of about 18°, as shown in FIG. 1. Some boom types are constructed to swing in an arc of up to 360°, and such types of booms are considered to be suitable for carrying out the present invention. In the case of a backhoe, the term "boom" can mean either the portion of the machine that attaches to the frame and reaches to the highest point where it connects to the dipperstick, or the boom/dipperstick combination.

The boom can also be of a type which traverses a track or rail. Positioning means for horizontally and vertically positioning the boom are generally conventional and may be powered by any conventional powering means, including, but not limited to, hydraulic motors and/or rams, electric motors or internal combustion engines with gears, levers, or screw drives, and the like.

The wood splitter can be of any conventional type which drives a wedge into the end of a piece of wood. The wood splitter can be powered by any conventional powering means, including, but not limited to, hydraulic motor or ram, electric motor or internal combustion engine with gears, levers, screw drives, and/or the like.

A first critical feature of the present invention is that the wood splitter is mounted in a downward orientation in order to pick up wood pieces on the ground for splitting the same. The wedge and anvil extend downwardly from the beam thereof, enabling the splitter to grasp a piece of wood therebetween.

The wood splitter has two functions in the present invention, each of which can be utilized independently. First, the wood splitter is used to grasp and pick up a wood piece in order to transfer the same to another location, such as a truck bed or trailer. Second, the wood splitter is used in conventional fashion to split wood.

A second critical feature of the present invention defined and described herein is a connecting member. The connecting member has horizontalizing means for maintaining the woodsplitter in a generally horizontal attitude, and a traversing means for traversing (rotating on a generally vertical axis) the wood splitter into a selectable position which is in alignment with the ends of a wood piece.

The preferred connecting member has a horizontalizing means which comprises a proximal component which is pivotally connected in hanging fashion to the distal end of a boom, especially a backhoe dipperstick, so that the connecting member maintains a generally downward orientation as the angle of the boom relative to the ground varies as the boom is moved upwardly and downwardly. This ensures that the wood splitter will maintain a generally horizontal attitude in order to reach to the ground and grasp wood pieces.

The preferred connecting member also has a traversing means which comprises a distal component which is rotatably connected in an inverted turret fashion relative to the proximal component. The function of the distal component is to traverse (rotate about a generally vertical axis) the wood splitter into a selectable position which is in alignment with the ends of a wood piece in order to grasp the same. The distal component mechanically traverses in an arc of preferably at least 180°, and most preferably at least 360°. Although a traversal arc of less than 180° is considered operable, it is not considered to be convenient. Powering means for powering the traversing means can be any of the same mentioned hereinabove.

The connecting member can comprise any of various conventionally known structures capable of performing the functions described herein for the horizontalizing means and the traversing means. Therefore, such conventionally known structures are expressly deemed to fall within the scope of the present invention.

The wood splitter is rigidly mounted to the bottom of the distal component so that the wood splitter is oriented with the wedge and anvil extending downwardly from the beam thereof, and is traversable via the traversing means.

FIGS. 1 and FIGS. 2–5 show different embodiments of the invention, with like elements having like numeric labels. A typical backhoe boom 11 comprises a boom 13 and a dipperstick 15, the distal end 17 of which is a connecting member 23. Positioning means for horizontally and vertically positioning the boom are shown as hydraulic cylinders 19, 21.

In FIG. 1, the connecting member 23 is comprised of a proximal component 25 and a distal component 27. The proximal component 25 is supported by the boom 11 via a pivot pin 29 which hingably connects the proximal component 25 to the distal end 17 of the dipperstick 15. The distal component 27 is rotatably connected to the proximal component 25 via a conventional bearing 31, usually a thrust bearing, and preferably in pairs of tapered roller bearings as is found in the non-drive wheels of many automobiles. A driven gear 33 is driven by a driving gear 35 powered by an electric or hydraulic traversing motor 37.

A conventional wood splitter 51 comprises a beam 53, a wedge 55 an anvil 57, and a ram 59. The wood splitter 51 is shown in a position oriented downwardly, as described hereinabove.

The beam 53 is rigidly connected to the distal component 27 via a rigid connection 61 at a location at least in the vicinity of the average center of gravity of the wood splitter 51, with the knowledge that the center of gravity shifts with movement of the anvil 57, and with a wood piece in place.

In another embodiment the present invention, shown in FIGS. 2–5, the connecting member 23 is modified so that the traversing motor 137 is located inside the proximal component 125 with its output shaft 141 axially aligned with the axis of the distal component 127. A conventional coupler 143 imparts rotation from the output shaft 141 to the distal component 127. The traversing motor 137 can be direct-drive, or can be geared down via an internal or external gear box.

Figure 2:
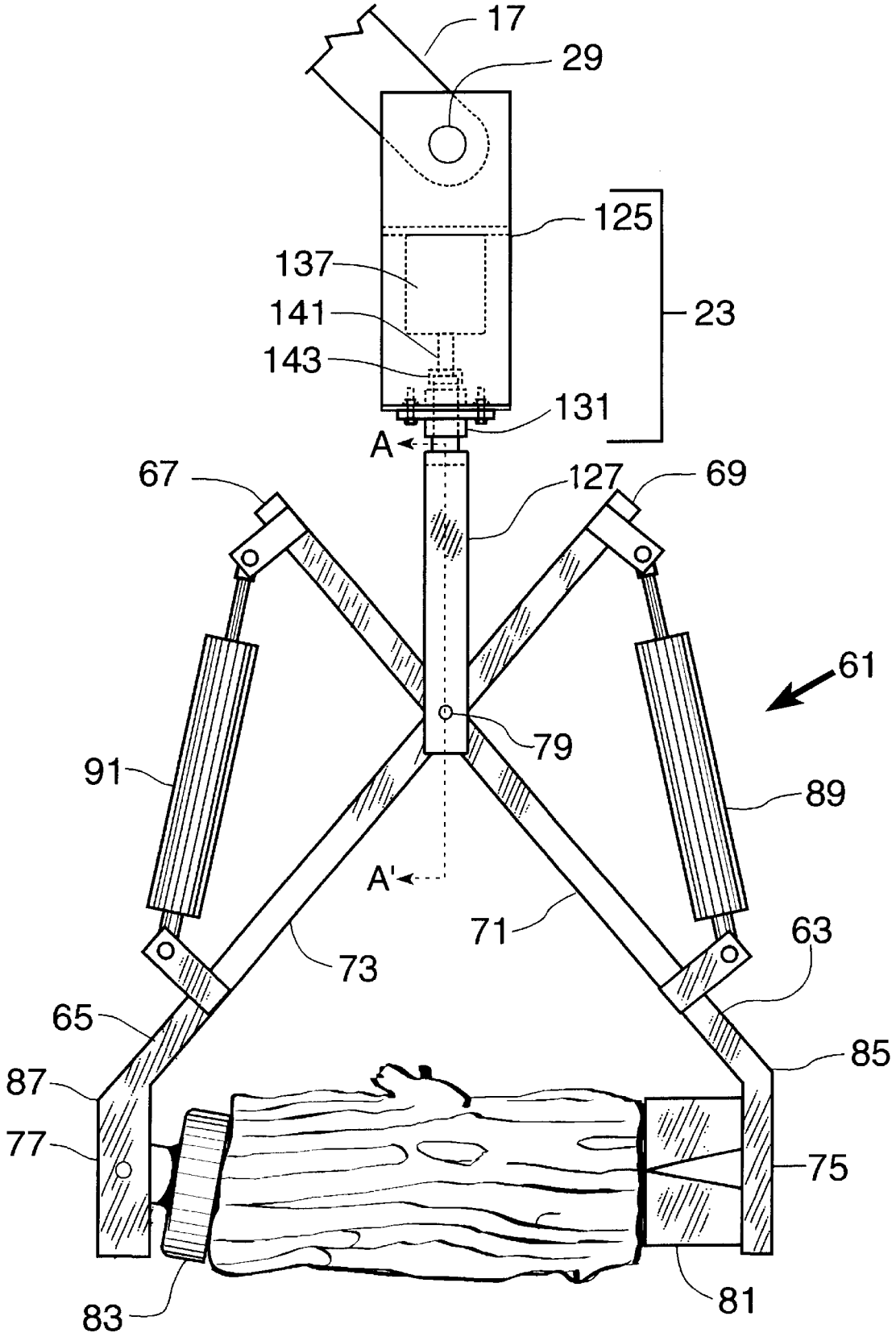
FIG. 2 is schematic side view, not to scale, of a combination wood splitter and loader in accordance with another embodiment of the present invention.
Figure 3:
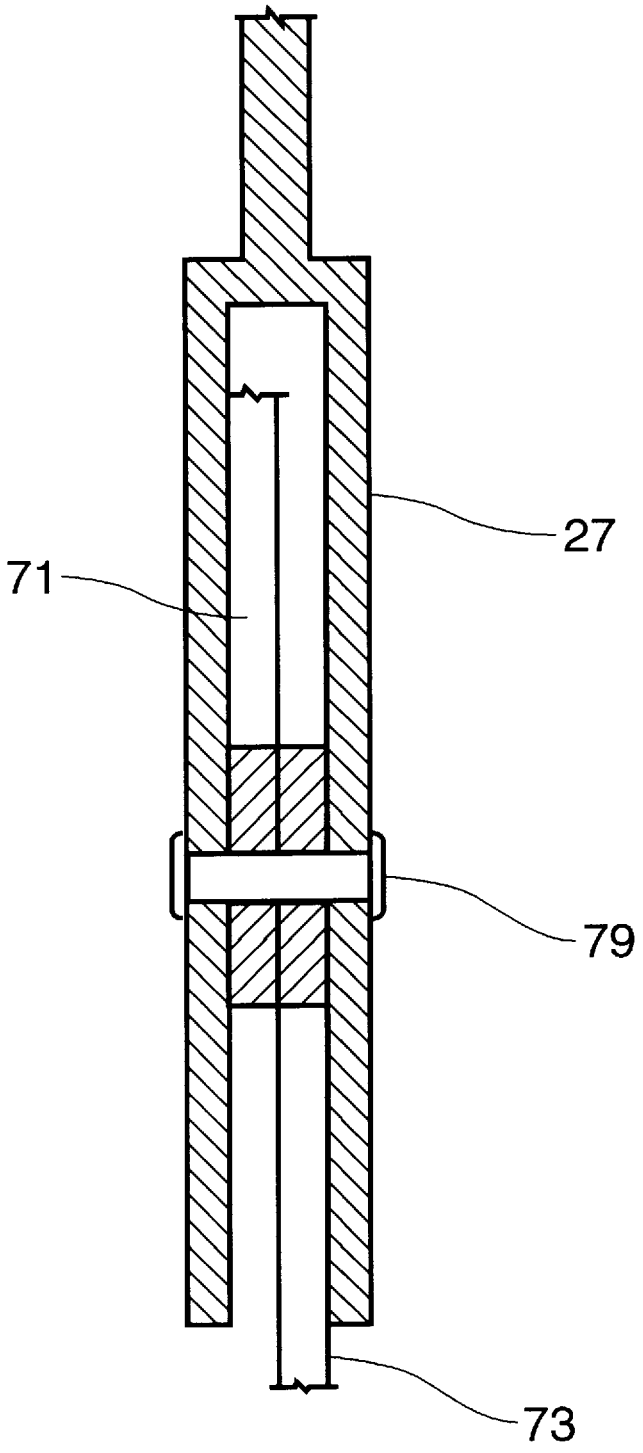
FIG. 3 is an enlarged view through section A–A' of FIG. 2.
Figure 4A:
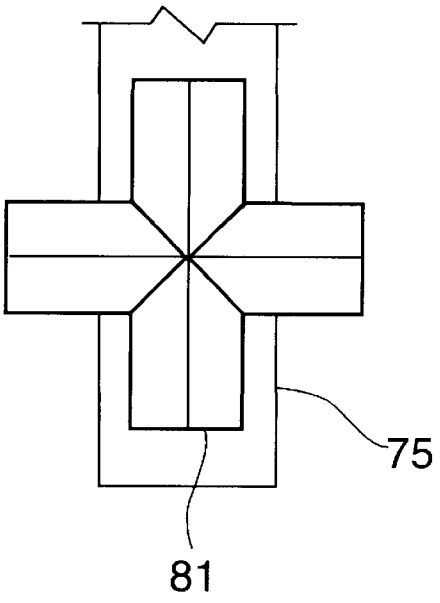
FIG. 4*a* is an enlarged face view of the wedge shown in FIG. 2.
Figure 4B:
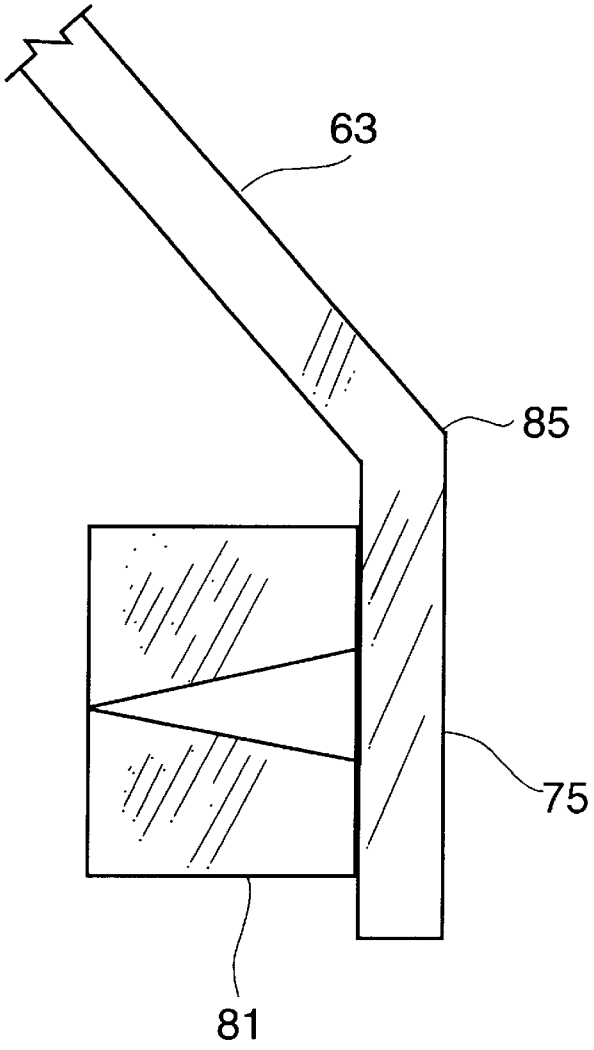
FIG. 4*b* is an enlarged side view of the wedge shown in FIG. 2.
Figure 5:
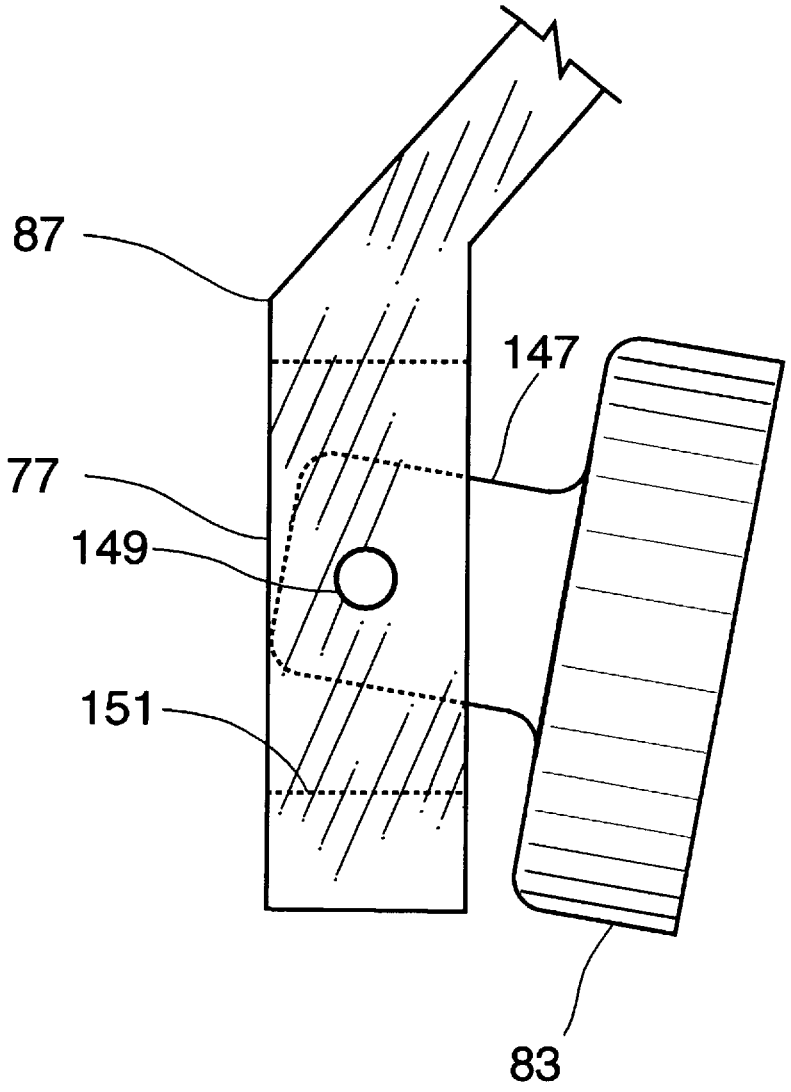
FIG. 5 is an enlarged side view of the anvil shown in FIG. 2.

Moreover, FIG. 2 shows a new type of wood splitter 61 fashioned especially for use from a hanging position, which is particularly suitable for the present invention. Two elongated levers 63, 65 have respective upper ends 67, 69, middle regions 71, 73, and lower ends 75, 77. The elongated levers 63, 65 are pivotally connected at a pivot 79 to each other for the relative swinging of the lower ends 75, 77 toward and away from each other. The distal component 127 is fork shaped and functions similarly to that of a bicycle fork, rotating about a vertical axis while supporting members (elongated levers 63, 65) which rotate on a horizontal axis. It can be seen, then, that the elongated levers 63, 65 are pivotally supported at the pivot 79 inside the fork of the distal component 127. A double wedge 81 is connected to one end 75, and an anvil 83 (or another wedge, not illustrated) is connected to the other end 77 facing each other. The lower ends may be bent or angled 85, 87 to improve the direction of the wedge 81 and anvil 83.

Powering means is employed to urge the upper end 69 of one elongated lever 65 away from the lower end 75 of the other elongated lever 63, and preferably to also urge the upper end 69 of one elongated lever 65 away from the lower end 75 of the other elongated lever 63 to force the lower ends 75, 77 toward each other. For example, FIG. 2 shows a ram 89 which is operably connected to the upper end 69 of one elongated lever 65 and the lower end 75 of the other elongated lever 63. It is preferred, although not absolutely necessary, to have a second ram 91 operably connected to the upper end 69 of one elongated lever 65 and the lower end 75 of the other elongated lever 63. Extension of the ram 89 or rams 89, 91 swings the lower ends 75, 77 toward from each other, forcing the wedge 81 and anvil 83 toward each other in order to grasp and/or split wood.

The anvil 83 in FIG. 2 is shown having a shank 147 rotatably disposed via a pin 149 in a slot 151 in the lower end 77 of the respective elongated lever 65. This arrangement allows the anvil to automatically adjust to the angle of the respective end of a wood piece which is crooked and/or cut at an angle, and also the changing relative angles of the elongated members 63, 65 as the wood is split.

While there has been shown and described what are at present considered the preferred embodiments of the invention, it will be obvious to those skilled in the art that various changes and modifications can be made therein without departing from the scope of the inventions defined by the appended claims.

What is claimed is:

1. Apparatus mountable to a support vehicle for splitting and loading firewood, said apparatus comprising:

a. a rigid connecting member, said connecting member having a proximal component and a distal component, said proximal component mountable to said support vehicle, said distal component traversably mounted to said proximal component;

b. traversing means for traversing said distal component relative to said proximal component; and c. a wood splitter supported in a downward orientation by said connecting member and rigidly mounted to said distal component, said wood splitter traversable via said traversing means into a selectable position which is in alignment with the ends of a wood piece.

2. Apparatus in accordance with claim 1 wherein said connecting member is adapted to maintain alignment with a generally vertical axis and wherein said distal component is traversable via said traversing means about said vertical axis.

3. Apparatus in accordance with claim 1 wherein said support vehicle comprises at least one of a tractor, a truck, a backhoe, a forklift, a crane, a loader, a dragline, a recreational vehicles, or an earth-moving vehicle.

4. Apparatus in accordance with claim 1 further comprising powering means for powering said traversing means.

5. Apparatus in accordance with claim 1 further comprising powering means for powering said wood splitter.

6. Apparatus in accordance with claim 1 wherein said distal component has a fork, and wherein said wood splitter further comprises:

a. a first elongated member having an upper end and a lower end;

b. a second elongated member having an upper end and a lower end; and c. a wood splitter wedge operably attached to at least one of said lower ends, said first elongated member and said second elongated member pivotally disposed in said fork for the relative swinging of said lower ends toward and away from each other.

7. A wood splitter in accordance with claim 6 further comprising powering means for urging said upper end of said first elongated member away from said lower end of said second elongated member to force said lower ends toward each other.

8. A wood splitter in accordance with claim 7 further comprising powering means for urging said upper end of said second elongated member away from said lower end of said first elongated member to force said lower ends toward each other.

9. Apparatus for splitting and loading firewood comprising:

a. a boom having a distal end which is vertically and horizontally positionable;

b. a positioning means for vertically and horizontally positioning said distal end of said boom;

c. a rigid connecting member supported by said boom, said connecting member having a proximal component and a distal component, said proximal component operably connected in hanging fashion to said distal end of said boom, said distal component traversably mounted to said proximal component, said distal component including traversing means for traversing said distal component relative to said proximal component; and d. a wood splitter supported in a downward orientation by said connecting member and rigidly mounted to said distal component, said wood splitter traversable via said traversing means into a selectable position which is in alignment with the ends of a wood piece.

10. Apparatus in accordance with claim 9 wherein said boom comprises a back hoe dipperstick.

11. Apparatus in accordance with claim 9 further comprising powering means for powering said positioning means.

12. Apparatus in accordance with claim 9 further comprising powering means for powering said traversing means.

13. Apparatus in accordance with claim 9 further comprising powering means for powering said wood splitter.

14. Apparatus in accordance with claim 9 wherein said distal component has a fork, and wherein said wood splitter further comprises:

a. a first elongated member having an upper end and a lower end;

b. a second elongated member having an upper end and a lower end; and c. a wood splitter wedge operably attached to at least one of said lower ends, said first elongated member and said second elongated member pivotally disposed in said fork for the relative swinging of said lower ends toward and away from each other.

15. A wood splitter in accordance with claim 14 further comprising powering means for urging said upper end of said first elongated member away from said lower end of said second elongated member to force said lower ends toward each other.

16. A wood splitter in accordance with claim 15 further comprising powering means for urging said upper end of said second elongated member away from said lower end of said first elongated member to force said lower ends toward each other.

17. A wood splitter adapted for operating from a hanging position comprising:

a. a first elongated member having an upper end and a lower end;

b. a second elongated member having an upper end and a lower end;

c. a connecting member having a fork; and d. a wood splitter wedge operably attached to at least one of said lower ends, said first elongated member and said second elongated member pivotally disposed in said fork for the relative swinging of said lower ends toward and away from each other.

18. A wood splitter in accordance with claim 17 further comprising powering means for urging said upper end of said first elongated member away from said lower end of said second elongated member to force said lower ends toward each other.

19. A wood splitter in accordance with claim 18 further comprising powering means for urging said upper end of said second elongated member away from said lower end of said first elongated member to force said lower ends toward each other.

* * * * *